United States Patent [19]

Horii et al.

[11] 4,370,601

[45] Jan. 25, 1983

[54] HIGH PRESSURE DISCHARGE LAMP APPARATUS

[75] Inventors: Shigeru Horii, Suita; Nobuhisa Yoshikawa, Sakai; Kazutaka Koyama, Nishinomiya, all of Japan

[73] Assignee: Matsushita Electric Industrial Co., Ltd., Kadoma, Japan

[21] Appl. No.: 255,635

[22] Filed: Apr. 20, 1981

[30] Foreign Application Priority Data

Apr. 21, 1980 [JP] Japan ..... 55-53063

[51] Int. Cl.[3] ..... G05F 1/00

[52] U.S. Cl. ..... 315/307; 315/DIG. 2; 315/DIG. 7; 315/207

[58] Field of Search ..... 315/307, DIG. 7, DIG. 2, 315/207, 172, 174, 289

[56] References Cited

U.S. PATENT DOCUMENTS

| | | | |
|---|---|---|---|
| 3,886,045 | 5/1975 | Kubo | 315/151 |
| 3,890,537 | 6/1975 | Park | 315/307 |
| 4,240,009 | 12/1980 | Paul | 315/307 |

*Primary Examiner*—Harold A. Dixon

*Attorney, Agent, or Firm*—Cushman, Darby & Cushman

[57] ABSTRACT

In a high pressure discharge lamp apparatus comprising a discharge tube and a current limiting device connected in series, an over-current protecting semiconductor switching device such as a triac (TC) is further connected in series to said discharge tube, the triac (TC) being controlled of its firing angle responding to an output of a current detection circuit which detects a change of the lamp current through a change of the lamp voltage, and a pulse generator is further connected in parallel to the discharge tube and gives reignition pulse thereto at least during the zero-current period in each cycle of the lamp current.

5 Claims, 9 Drawing Figures

$V_S$
$\theta_1$
$V_1$
$V_2$
$V_3$
$I_{La}$
$V_P$ $V_S$
$\theta_2$
$V_1$
$V_2$
$V_3$
$I_{La}$
$V_P$

HIGH PRESSURE DISCHARGE LAMP APPARATUS

BACKGROUND OF THE INVENTION

1. Field of the Invention

This invention relates to an improvement in a high pressure discharge lamp apparatus such as a high pressure mercury lamp apparatus, a high pressure sodium lamp apparatus, or a high pressure metal-halide lamp apparatus. The present invention especially concerns an improvement in a high pressure discharge lamp apparatus of the type comprising a high pressure discharge tube, a current limiting device, for instance a choke coil, and a pulse generator output terminals of which are connected in parallel to the electrodes of the discharge tube for lighting the tube with a lamp voltage nearly equal to a power source voltage.

2. Description of the Prior Art

Generally, in a conventional high pressure discharge lamp apparatus, a current limiting device such as a choke coil and a discharge tube are connected in series across a power source.

In the abovementioned type of the high pressure discharge lamp apparatus, a voltage of the power source should be maintained over 1.5 times a voltage of the discharge tube for preventing an extinction of ignition in the tube. Therefore a voltage drop across the current limiting device is high, and a power loss at the current limiting device is rather large. Accordingly, a dimension and a weight of the current limiting device become undesirably large.

For improving the high pressure discharge lamp apparatus to eliminate the abovementioned defects, a pulse generator may be provided in a manner to give pulses to the discharge tube. By such impression of pulses across the discharge tube, the lamp voltage can be selected so high as to be nearly equal to the power source voltage.

The conventional discharge lamp apparatus having a pulse generator as abovementioned still has the following problems:

(1) In a case that the high pressure discharge lamp is ignited in every cycle of the power source voltage by impressing of pulse by the pulse generator, a lamp voltage can be selected so high as to be nearly equal to the power source voltage, and an impedance of the current limiting device can be selected small. But, when the discharge tube starts to ignite, a lamp current grows excessively large, and therefore the impedance of the discharge tube such as the choke coil becomes almost zero for a magnetic saturation due to the overcurrent. Therefore, for avoiding the magnetic saturation, the choke coil as the current limiting device should be designed so as to have relatively large sectional area of a core thereof, thereby making the current limiting device large in dimension and expensive in cost.

(2) In order to solve the abovementioned problem, another conventional high pressure discharge lamp apparatus has been devised as shown in FIG. 1, wherein a current limiting device 2 such as a choke coil, an auxiliary current limiting device 5 and a discharge tube 3 are connected in series across a power source 1. The auxiliary current limiting device 5 of a relatively large size has more large capacity of current limitation than that of the current limiting device 2. And a semiconductor switching device 6 is connected in parallel to the auxiliary current limiting device 5. A pulse generator 4 is connected in parallel to the discharge tube 3 for supplying reignition pulses to the discharge tube 3.

In the abovementioned high pressure discharge lamp apparatus, a duty time of the current limiting device 5 is controlled by firing angle controlling action of the semiconductor switching device 6 in such a manner that at the starting the duty time of the switching device 6 is very small and at the steady lighting state the duty time is very large, so that effectively the auxiliary current limiting device 5 is substantially short circuited by the switching device 6 at a steady lighting state of the lamp. Therefore a lamp current may be maintained for the same degree between at a steady lighting state and at a starting transient state.

Generally, in the high pressure discharge tube an ignition of the discharge tube extincts every period when the lamp current is zero. Accordingly, if a series insertion of a thyristor to the high pressure discharge lamp of conventional type for attempting to limit the lamp current by changing its firing angle, the tube does not work due to zero current period in every cycle. Therefore, in the lamp apparatus of FIG. 1, lamp current is always supplied from the power source 1 through the auxiliary current limiting device 5, which is connected in parallel to the thyristor or the like current limiting device 6, thereby to allow the current to flow without zero period made by the thyristor 6. However the problem of the conventional lamp apparatus is that though the current limiting device 2 can be designed relatively small, a large auxiliary current limiting device 5 has been necessary. Accordingly the lamp apparatus can not be made in small size.

SUMMARY OF THE INVENTION

This invention provides a high pressure discharge lamp apparatus having a pulse generator to impress pulses across the discharge tube for allowing selecting a lamp voltage very close to a power source voltage, and having no auxiliary current limiting device like the device 5 of the conventional high pressure discharge lamp apparatus shown in FIG. 1.

DESCRIPTION OF PREFERRED EMBODIMENTS

The high pressure discharge lamp apparatus of the present invention comprises a discharge tube and a current limiting device connected in series, an over-current protecting device is further connected in series to the discharge tube, the over-current protecting device being controlled of its firing angle responding to an output of a current detection circuit, and a pulse generator is further connected in parallel to the discharge tube.

Figure 1:
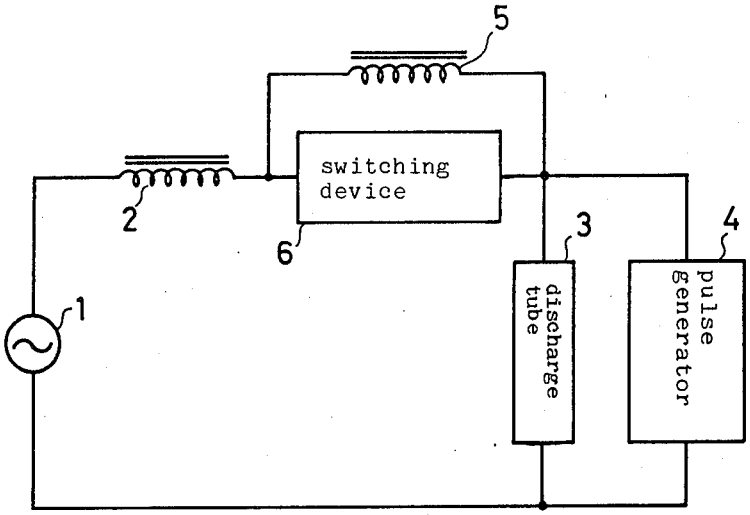
FIG. 1 (Prior Art)
FIG. 1 is a block diagram of a conventional high pressure discharge lamp apparatus.
Figure 2:
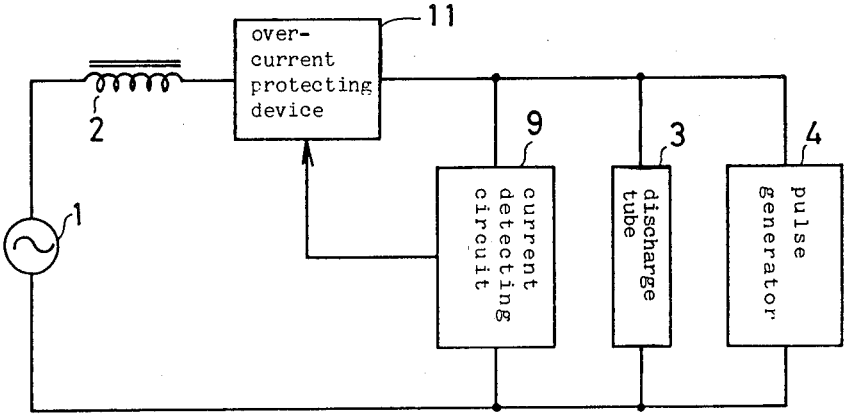
FIG. 2 is a block diagram of a fundamental apparatus embodying the present invention.

A fundamental apparatus embodying the present invention is shown in FIG. 2.

In FIG. 2, a current limiting device 2 and an over-current protecting device 11 are connected in series with a discharge tube 3 across a power source 1. A pulse generator 4 is connected in parallel to the discharge tube 3 for supplying reignition pulses to the discharge tube 3. And a lamp current detecting circuit 9 for detecting a lamp current and giving a control signal to the over-current protecting device 11 is connected in parallel to the discharge tube 3. The pulse generator 4 is for preventing extinction of the tube and allowing a selection of a lamp voltage high enough close to a voltage of the power source 1, by supplying the reignition pulses to the discharge tube 3, during a period from near the zero-cross point of the voltage of the power source 1 to a stated point far from the zero-cross point in every cycle of the voltage of the power source 1. By means of the reignition pulses, extinction of the ignition in the discharge tube 3 may be effectively avoided even in the zero current period in each cycle of the lamp current.

Figure 3:
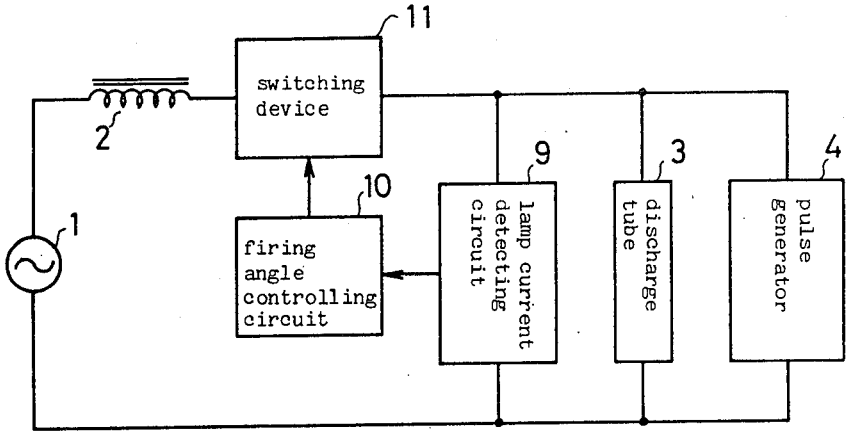
FIG. 3 is a block diagram of the actual apparatus embodying the present invention.

FIG. 3 shows an apparatus embodying the present invention which uses a semiconductor switching device 11 as the over-current protector and uses a lamp current detecting circuit 9, which in actual circuit is a voltage detection circuit which outputs a signal to indicate a voltage of the discharge tube 3 and has a specified relation with the lamp current. In an embodiment of the present invention shown in FIG. 3, a current limiting device 2 (of passive element device such as a choke coil) and the semiconductor switching device 11 as the over-current protector and a discharge tube 3 are connected in series across a power source 1. A pulse generator 4 for impressing reignition signal on the discharge tube 3 is connected in parallel to the latter. The lamp current detecting circuit 9 is connected in parallel to the discharge tube 3. And a firing angle controlling circuit 10 is disposed so as to receiving an out-put signal of the lamp current detecting circuit 9 and supply a firing angle controlling signal to the switching device 11. A firing angle of the switching device 11 is controlled based on a relation between the lamp current and the lamp voltage which is detected in the lamp current detecting circuit 9. And the switching device 11 controls the firing angle, hence effective value of the current of the discharge tube 3 from the power source 1, and thereby protects an over-current at the starting transient state. The pulse generator 4 supplies reignition pulses in every cycle to the discharge tube 3 at least during the zero current period of the lamp current in order for avoiding an extinction of the discharge tube 3 due to zero current period both in starting transient state and steady lighting state.

Figure 4:
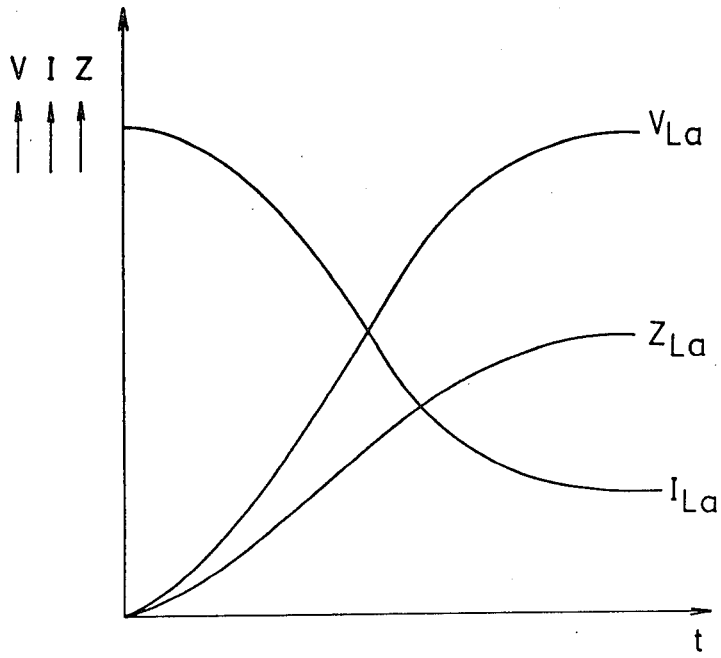
FIG. 4 is a graph showing characteristic curves of a high pressure discharge tube at a starting transient state.

Generally, in a high pressure discharge tube connected in series with choke coil or some impedance, for a starting transient state of the tube, a lamp voltage $V_{La}$ and a lamp current $I_{La}$ of the high pressure discharge tube show the curves as shown in FIG. 4. In FIG. 4, $Z_{La}$, which is relatively small at incipient period of starting of lighting in the discharge tube wherein a vapour pressure in the tube is relatively small. Then as time lapses the impedance $Z_{La}$ increases. For that reason, the lamp current $I_{La}$, that is a current through the choke coil, decreases at the time lapses, and simultaneously the lamp voltage $V_{La}$ increases as shown in FIG. 4. Accordingly, the amount of the lamp current $I_{La}$ can be known by detecting the lamp voltage $V_{La}$ based on abovementioned relation between the current $I_{La}$ and the voltage $V_{La}$. Consequently, the lamp current $I_{La}$ can be controlled by detecting the lamp voltage $V_{La}$ primarily.

Figure 5:
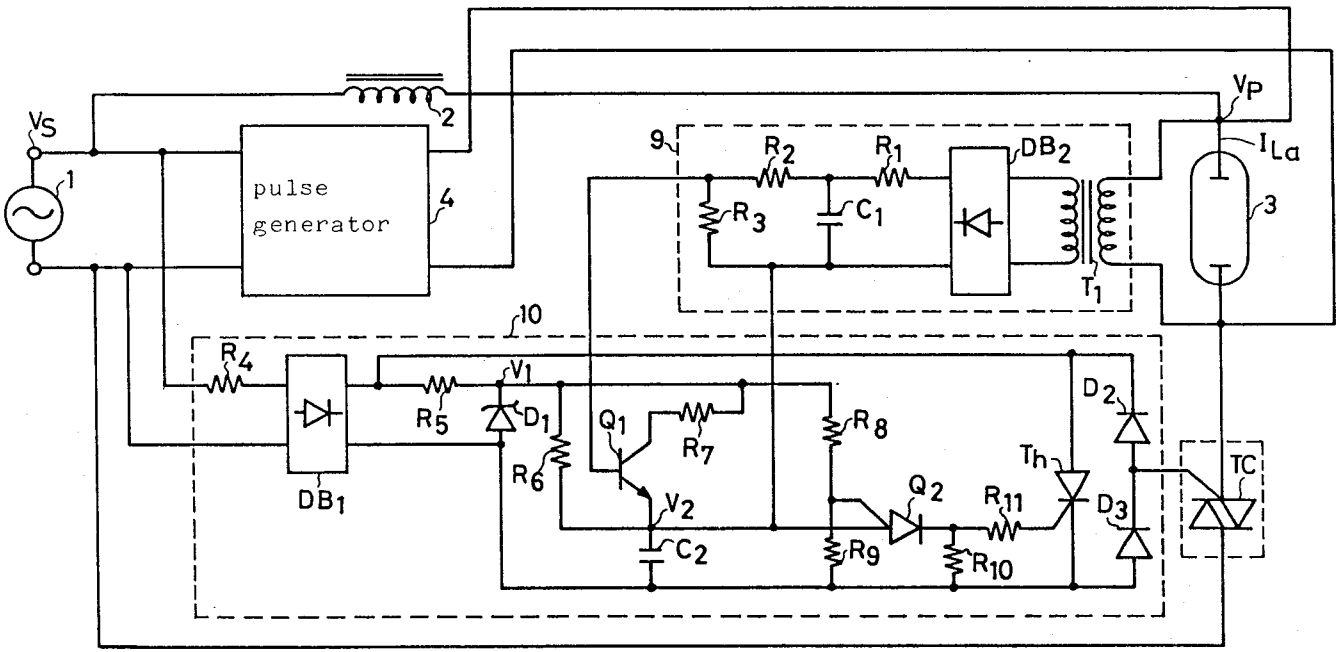
FIG. 5 is a detailed circuit diagram of the apparatus of the present invention shown in FIG. 3.
Figures 7A, 7B:
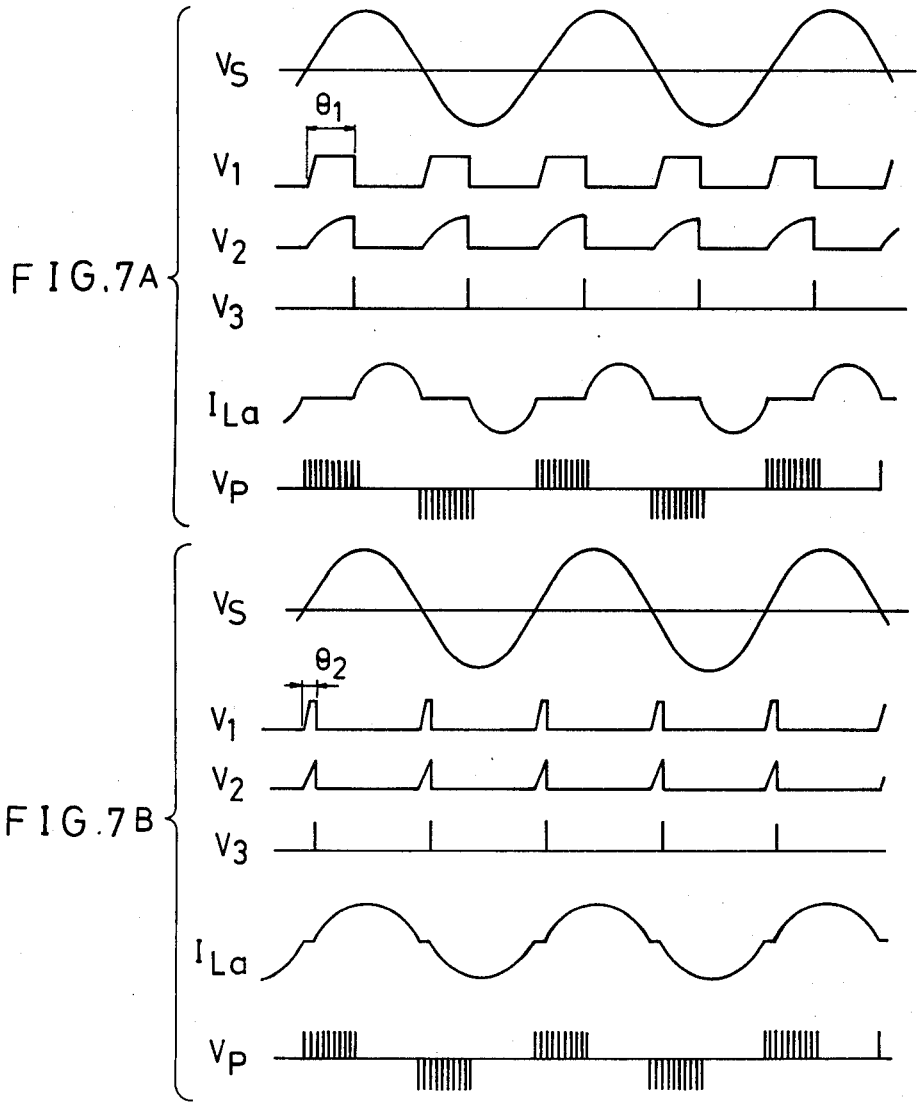
FIG. 7A and FIG. 7B are wave-form charts showing wave-forms at various parts of the circuit shown in FIG. 5.

The operation of the over-current protection in accordance with the high pressure discharge lamp apparatus of the present invention is elucidated hereinafter referring to FIG. 5, FIG. 7A and FIG. 7B. FIG. 5 is a circuit diagram of the apparatus of the present invention corresponding to FIG. 3. FIG. 7A and FIG. 7B are wave-form chart of various parts of the circuit shown in FIG. 5. In the chart of FIG. 5, a voltage across the discharge tube 3 is impressed to the lamp current detecting circuit 9 which detects a lamp current by detecting a lamp voltage. That is, in a present invention, the lamp current is easily detected by a simple circuit as shown in FIG. 5. In the lamp current detecting circuit 9, the lamp voltage having a certain relation with the lamp current as shown in FIG. 4 is stepped down by a transformer $T_1$, and rectified by a diode bridge circuit $DB_2$, and further smoothed by a circuit of resistor $R_1$ and a capacitor $C_1$. A voltage of the capacitor $C_1$ is divided by a circuit of resistors $R_2$ and $R_3$, and then impressed to the base of a transistor $Q_1$ in a firing angle controlling circuit 10. At immediately after a starting of lighting of the discharge tube 3, lamp voltage $V_{La}$ is low as shown in FIG. 4. Therefore a voltage impressed to the base of the transistor $Q_1$ is also in a low level, so that the transistor $Q_1$ maintains off state. On the other hand, a power source voltage having the wave-form $V_S$ shown in FIG. 7A is given to the firing angle controlling circuit 10, wherein the power source voltage $V_S$ is led through a resistor $R_4$, $DB_1$ and $R_5$, and then is level clipped by a regulate diode $D_1$, whose voltage wave form $V_1$ is shown in FIG. 7A. The voltage wave-form $V_1$ is supplied to an anode of PUT (programmable unijunction transistor) $Q_2$ through a resistor $R_6$. At the immediately after a starting of lighting of the discharge tube 3, the transistor $Q_1$ maintains off state as abovementioned, and hence the voltage of waveform $V_1$ is supplied to a capacitor $C_2$ for charging only through the resistor $R_6$. As a result of the charging, a voltage wave-form $V_2$ of the capacitor $C_2$ is formed as shown in FIG. 7A. As shown in FIG. 5, the voltage of wave-form $V_1$ is divided by resistors $R_8$ and $R_9$, and the divided voltage is impressed to a gate of the PUT $Q_2$. Hereupon, the voltage $V_2$ of the capacitor $C_2$ grows up and comes above the voltage impressed to the gate of the PUT $Q_2$, hence the PUT $Q_2$ turns on. Consequently the electric charge in the capacitor $C_2$ discharges through the PUT $Q_2$. As a result, a trigger pulse $V_3$ as shown in FIG. 7A is produced across both ends of a resistor $R_{10}$. A thyristor Th is triggered by the pulses $V_3$ impressed through a resistor $R_{11}$. When the thyristor Th turns on, both out-put ends of the diode bridge circuit $DB_1$ are short-circuited by the thyristor Th, and hence the voltage $V_1$ becomes zero, and then triggering action of the PUT $Q_2$ is stopped. As abovementioned, the PUT $Q_2$ turns on at a firing angle corresponding to the time constant resistor $R_6$ and the capacitor $C_2$, and therefore, the thyristor Th turns on by receiving the triggering pulses $V_3$ impressed to the gate thereof through the resistor $R_{11}$. As a rectified source voltage is supplied to the thyristor Th through the diode bridge circuit $DB_1$, the thyristor Th maintains "on" state until a forward current thereof becomes lower than a holding current of the thyristor Th at a timing near an end of every positive half cycle of the power source voltage $V_S$. When the thyristor Th is in "on" state and the power source voltage $V_S$ is in the positive half cycle, a gate current flows in the triac TC as a switching device 11 (in FIG. 3) through the path of:

power source 1—current limiting device 2—discharge tube 3—gate of the triac TC—diode $D_2$—thyristor Th—diode bridge circuit $DB_1$—power source 1. And when the power source voltage $V_S$ is in the negative half cycle, the gate current of the triac TC flows through the path of:

power source 1—diode bridge circuit $DB_1$—thyristor Th—diode $D_3$—gate of the triac TC—discharge tube 3—current limiting device 2—power source 1. In both cases of the positive half cycle and negative half cycle, the triac TC is "on" during the while the gate currents exist. Accordingly, a main load current $I_{La}$ of the triac TC is appropriately controlled by the firing angle controlling circuit 10 which determines a firing angle $\theta_1$ of the triac TC as shown in FIG. 7A. Although the main load current $I_{La}$ has a zero current period in each cycle, by means of the reignition pulses $V_P$ are supplied to the discharge tube 3 at least during the zero current period in each cycle of the main load current $I_{La}$.

After lapse of some time period, the lamp voltage increases, and also the base potential of the transistor $Q_1$ rises, so that the transistor $Q_1$ turns on. When the transistor $Q_1$ turns on, a series circuit of the resistor $R_7$ and the internal resistance (collector-emitter resistance) of the on-state transistor $Q_1$ is connected in parallel to the resistor $R_6$, and therefore a charging time of the capacitor $C_2$ is shortened. Accordingly a time till the PUT $Q_2$ turns on is shortened, and therefore the time phase of trigger pulses $V_3$ across the resistor $R_{10}$ is led, hence the firing angle of the triac TC becomes very small as shown by $\theta_2$ ($\theta_2 << \theta_1$) in FIG. 7B. As a result, main load current of a wide firing angle flows through the triac TC as shown in FIG. 7B. As above-mentioned, an apparatus of present invention has a pulse generator 4 and a switching device as an over-current protecting device, and the lamp current at the starting transient state is suppressed by over-current protecting device nearly equal to the lamp current at the steady lighting state, preventing the extinction by the reignition pulses from the pulse generator 4.

Therefore, the current limiting device 2 can be designed small enough and further a loss therein can be satisfactorily diminished.

Figure 6:
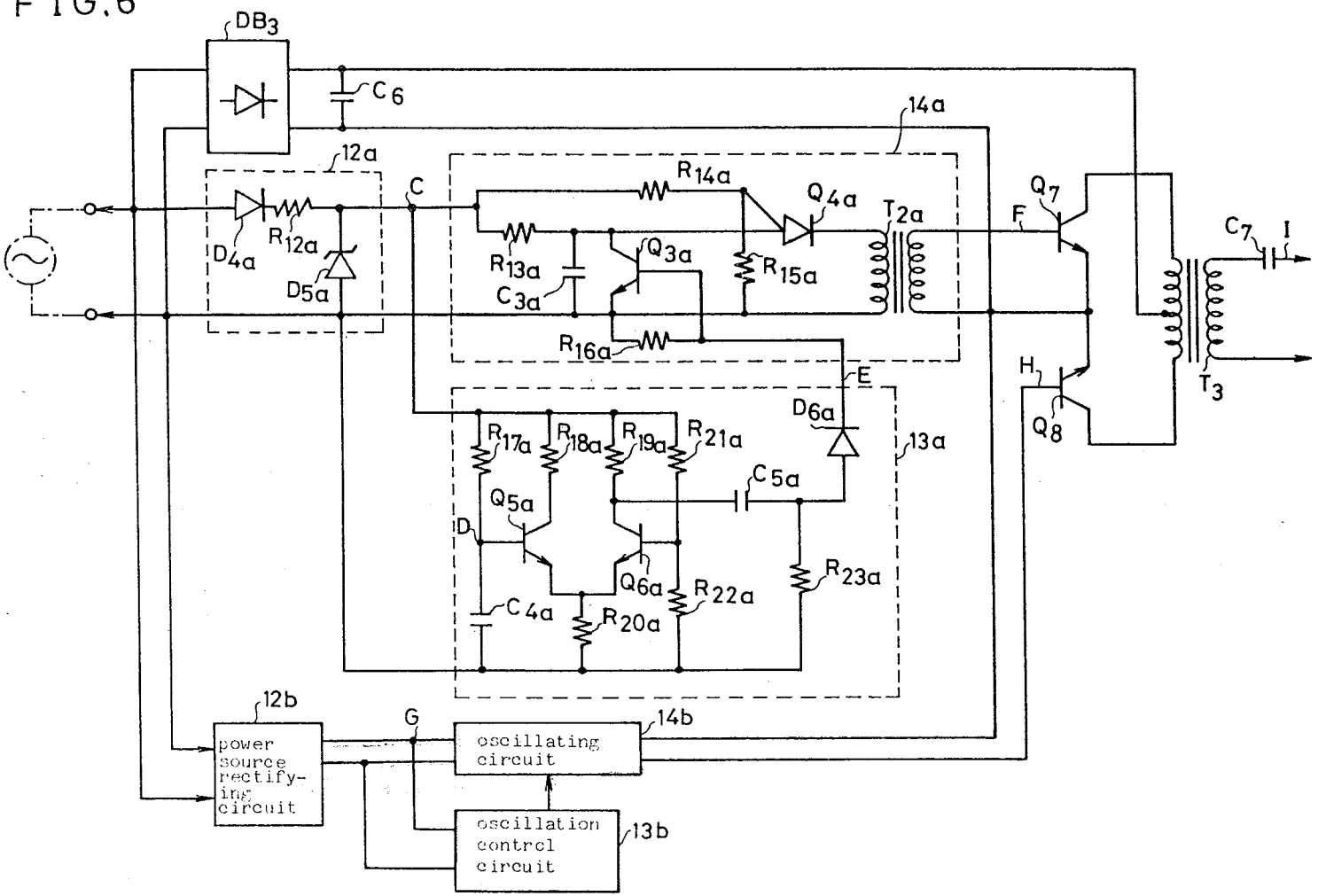
FIG. 6 is a detailed circuit diagram of a pulse generator shown in FIG. 5.
Figure 8:
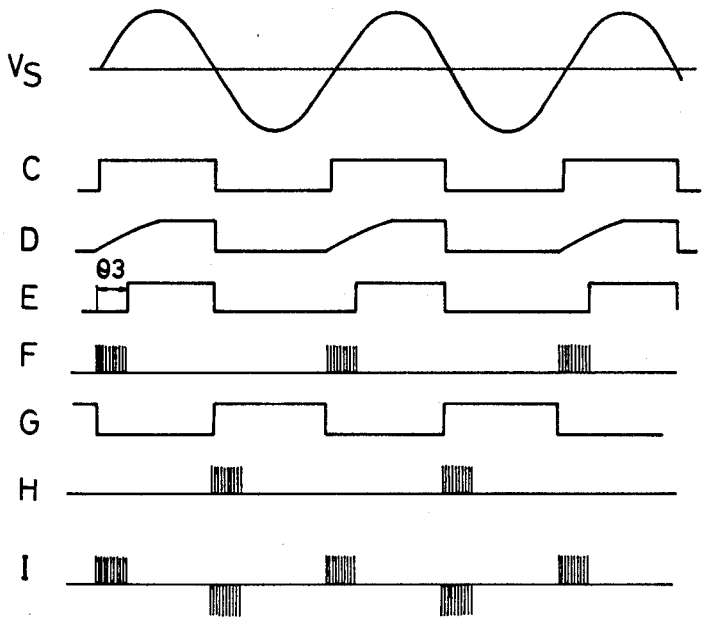
FIG. 8 is a wave-form chart showing wave-forms at various parts of the circuit shown in FIG. 6.

The aforementioned pulse generator 4 is elucidated in detail in reference to FIG. 6 and FIG. 8. FIG. 6 is a detailed circuit diagram of the pulse generator 4, and FIG. 8 is a wave-form chart of various parts of the circuit shown in FIG. 6. When the power source voltage $V_S$ is applied, the pulse generator 4 issues ignition pulses to the discharge tube 3, and the discharge tube 3 is ignited. Operation of the pulse generator 4 after starting of ignition is elucidated hereafter separating in two parts. First part is for the positive half cycle period of the power source voltage $V_S$ and the second part is for the negative half cycle period of the power source voltage $V_S$.

In the positive half cycle period: In the positive half cycle of the power source voltage $V_S$, the voltage $V_S$ is rectified and level clipped by a power source rectifying circuit 12*a* consisting of a diode $D_{4a}$, a resistor $R_{12a}$, and a regulate diode $D_{5a}$. An output voltage of the power source rectifying circuit 12*a*, that is a voltage of a point C in FIG. 6 is shown by a waveform C of FIG. 8. A voltage of the wave-form C is supplied to an oscillating circuit 14*a* and to an oscillation control circuit 13*a*. In the oscillation control circuit 13*a*, the voltage of the wave-form C is impressed to an integration circuit consisting of a resistor $R_{17a}$ and a capacitor $C_{4a}$, then an integrated voltage of the capacitor $C_{4a}$ at a point D in FIG. 6 is impressed to the base of a transistor $Q_{5a}$. A voltage wave-form D at the point D is shown in FIG. 8. A comparator consisting of two transistors $Q_{5a}$, $Q_{6a}$, and three resistors $R_{18a}$, $R_{19a}$, $R_{20a}$ is formed in the oscillation control circuit 13*a*. A voltage of the point C is divided by resistors $R_{21a}$ and $R_{22a}$ and impressed to the base of the transistor $Q_{6a}$ in the comparator. DC component voltage of the collector of the transistor $Q_{6a}$ as an output of the comparator is cut off by a capacitor $C_{5a}$, and the AC component is impressed on the base of a transistor $Q_{3a}$ in the oscillating circuit 14*a* through a diode $D_{6a}$. In the oscillating circuit 14*a*, an oscillation frequency determined by a time constant of a resistor $R_{13a}$ and a capacitor $C_{3a}$ is maintained during the off state of the transistor $Q_{3a}$. (A resistor $R_{14a}$ and a resistor $R_{15a}$ are adequately selected in a manner that a PUT $Q_{4a}$ maintains the oscillation.) When both ends of the capacitor $C_{3a}$ is short-circuited, an anode potential of the PUT $Q_{4a}$ changes to zero, and the oscillation stops. That is, in a duty time of a wave-form E, the oscillation is stopped as shown in FIG. 8. The wave-form E is for a voltage of an out-put of the oscillation control circuit 13*a* at a point E in FIG. 6. Pulse train is issued for the period of $\theta_3$ from the oscillating circuit of the PUT $Q_{4a}$ and impressed on a switching transistor $Q_7$, through a pulse transformer $T_{2a}$ thereby giving the input signal of the wave-form F shown in FIG. 8 for operation of the transistor $Q_7$.

In the negative half cycle period: In a negative half cycle of the power source voltage $V_S$, the voltage $V_S$ is rectified and level clipped by the power source rectifying circuit 12*b*. A negative cycle circuitry comprises a power source rectifying circuit 12*b*, an oscillating circuit 14*b*, and an oscillation control circuit 13*b*, and these are same with the positive cycle circuitry comprising the power source rectifying circuit 12*a*, the oscillating circuit 14*a*, and the oscillation control circuit 13*a* except a connection to the power sources thereof which are opposite each other. Accordingly, detail explanation about the negative cycle circuit construction is omitted here. In the negative half cycle of the power source voltage $V_S$, the voltage wave-form $V_S$ is transduced to a wave-form G of an out-put voltage of the power source rectifying circuit 12*b* as shown in FIG. 8. The oscillating circuit 14*b* issues pulses H shown in FIG. 8. Then the pulses H are impressed to a switching transistor $Q_8$. As a result, the transistor $Q_7$ is "on" in positive half cycle of the power source $V_S$, and the transistor $Q_8$ is "on" in negative half cycle of the power source $V_S$.

The power source voltage $V_S$ is allwave-rectified by a diode bridge circuit $DB_3$ and is smoothed by a smoothing capacitor $C_6$, then impressed on the transistors $Q_7$ and $Q_8$ through a transformer $T_3$. A pulse wave-form I shown in FIG. 8 having both polarity of pulses (reignition pulses) is issued from secondary winding of the transformer $T_3$, and is given to the discharge tube 3 through a capacitor $C_7$. Then the reignition pulses start an ignition and maintain a lighting. The capacitor $C_7$ cuts off a low frequency voltage component from the discharge tube 3 and prevents a magnetic saturation in the transformer $T_3$. A period that the reignition pulse issued from the pulse generator 4 can be controlled by a integration time of the oscillation control circuit 13*a* by determining the time constant of the resistor $R_{17a}$ and the capacitor $C_{4a}$, or the period can be controlled by a reference voltage of the comparator in the oscillation control circuit 13*a* by determining the voltage by the ratio of the resistors $R_{21a}$ and $R_{22a}$. An oscillation frequency at the oscillating circuit 14*a* can be controlled by, for instance, selecting the values of the resistor $R_{13a}$ and the capacitor $C_{3a}$. A reignition pulse impressing angle $\theta_3$ should be selected as $\theta_3 > \theta_1$ with respect to the firing angle $\theta_1$ or the zero-current period in each cycle of the lamp current.

Figure 9:
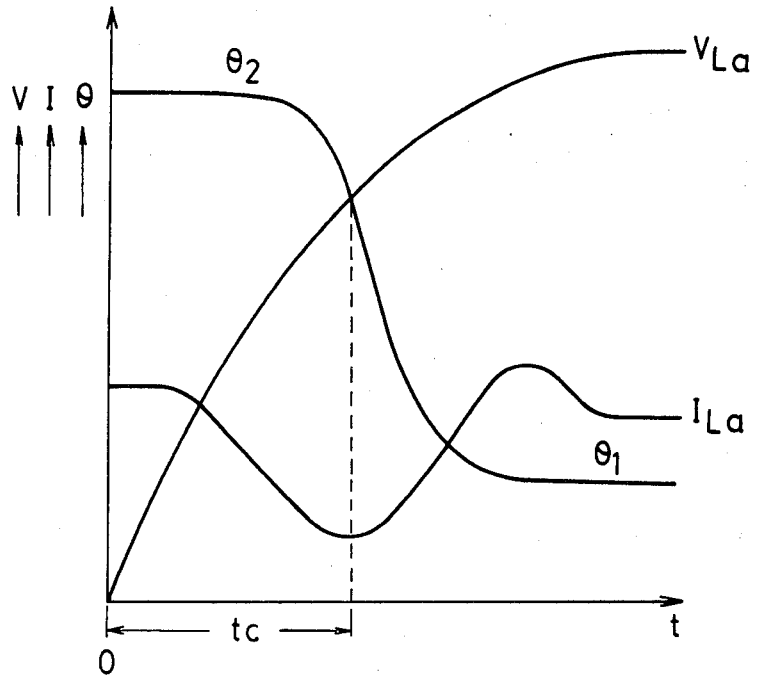
FIG. 9 is a graph showing performance curves of a high pressure discharge lamp apparatus of the present invention at a starting transient state.

Performance curves of the high pressure discharge lamp apparatus of the present invention at a starting transient state are shown in FIG. 9. In FIG. 9, characteristic of the lamp voltage is designated by the curve $V_{La}$, the lamp current by $I_{La}$, and firing angle at a condition that the starting lamp current is controlled during a period $t_c$ from starting of lighting of the discharge tube by $\theta$.

The transformer $T_1$ can be replaced by a suitable isolator for example, photo-isolator. The pulse generator 4 of FIG. 6 can be constituted by a digital IC, thereby a similar function is obtainable.

What we claim is:

1. A high pressure discharge lamp apparatus comprising:

a discharge tube, a current limiting device and an over-current protecting device which are connected in series with said discharge tube across a power source, a pulse generator connected in parallel to said discharge tube to supply pulses to said discharge tube, and a lamp current detecting circuit to detect a lamp current and give control signal to said over-current protecting device.

2. A high pressure discharge lamp apparatus of claim 1, wherein said over-current protecting device is a semiconductor switching device.

3. A high pressure discharge lamp apparatus of claim 1, wherein said lamp current detecting circuit includes a means for detecting lamp voltage.

4. A high pressure discharge lamp apparatus of claim 2, wherein a zero-current period in each cycle of said semiconductor switching device is controlled by a firing angle controlling circuit.

5. A high pressure discharge lamp apparatus of claim 4, wherein said pulse generator issues pulses for making a reignition of said discharge tube during at least said zero-current period in each cycle of said semiconductor switching device.

* * * * *